US009611737B2

(12) United States Patent
Davidson et al.

(10) Patent No.: US 9,611,737 B2
(45) Date of Patent: Apr. 4, 2017

(54) METHOD FOR DETERMINING REGIONS FOR STIMULATION ALONG A WELLBORE WITHIN A HYDROCARBON FORMATION, AND USING SUCH METHOD TO IMPROVE HYDROCARBON RECOVERY FROM THE RESERVOIR

(71) Applicants: Husky Oil Operations Limited, Calgary (CA); Wavefront Technology Solutions Inc., Edmonton (CA)

(72) Inventors: Brett C. Davidson, Edmonton (CA); Lawrence J. Frederick, Calgary (CA); Tor Meling, Edmonton (CA)

(73) Assignees: Husky Oil Operations Limited, Calgary (CA); Wavefront Technology Solutions Inc., Edmonton (CA)

( * ) Notice: Subject to any disclaimer, the term of this patent is extended or adjusted under 35 U.S.C. 154(b) by 162 days.

(21) Appl. No.: 14/029,707

(22) Filed: Sep. 17, 2013

(65) Prior Publication Data

US 2015/0075787 A1 Mar. 19, 2015

(51) Int. Cl.
*E21B 49/00* (2006.01)

(52) U.S. Cl.
CPC ..... *E21B 49/008* (2013.01)

(58) Field of Classification Search
None
See application file for complete search history.

(56) References Cited

U.S. PATENT DOCUMENTS

| | | | | |
|---|---|---|---|---|
| 4,099,563 | A | 7/1978 | Hutchison et al. | |
| 4,993,678 | A | 2/1991 | Easter | |
| 5,048,611 | A | 9/1991 | Cochran | |
| 7,405,998 | B2 | 7/2008 | Webb et al. | |
| 7,543,634 | B2 | 6/2009 | Fehr et al. | |
| 7,806,184 | B2 | 10/2010 | Schultz et al. | |
| 7,832,472 | B2 | 11/2010 | Themig | |
| 2009/0250207 | A1* | 10/2009 | May | 166/250.1 |
| 2011/0048724 | A1* | 3/2011 | Pringle et al. | 166/320 |
| 2012/0160524 | A1* | 6/2012 | Lumbye | 166/387 |
| 2014/0058686 | A1* | 2/2014 | Anderson et al. | 702/51 |

FOREIGN PATENT DOCUMENTS

CA 2701261 A1 10/2010

* cited by examiner

*Primary Examiner* — Jennifer H Gay
*Assistant Examiner* — Caroline Butcher
(74) *Attorney, Agent, or Firm* — Frost Brown Todd LLC

(57) ABSTRACT

A method for determining along a length of a wellbore situated in an underground hydrocarbon-containing formation, regions within the formation to inject a fluid at a pressure above formation dilation pressure, to stimulate production of oil into the wellbore. An initial information-gathering procedure is conducted prior to formation dilation/fracturing, wherein fluid is supplied under a pressure less than formation dilation or fracture pressure, to discrete intervals along the wellbore, and sensors measure and data is recorded regarding the ease of penetration of such fluid into the various regions of the formation. Regions of the formation exhibiting poor ease of fluid penetration or regions of higher oil saturation, are thereafter selected for subsequent stimulation or dilation, at pressures above formation dilation pressures. Where initial fluid pressures and/or formation dilation pressures are provided in cyclic pulses, a downhole tool is disclosed for such purpose.

11 Claims, 12 Drawing Sheets

METHOD FOR DETERMINING REGIONS FOR STIMULATION ALONG A WELLBORE WITHIN A HYDROCARBON FORMATION, AND USING SUCH METHOD TO IMPROVE HYDROCARBON RECOVERY FROM THE RESERVOIR

FIELD OF THE INVENTION

The present invention relates to a method of determining reservoir characteristics that can be used to infer best locations along a wellbore to apply well stimulation and/or hydraulic fracturing techniques.

BACKGROUND OF THE INVENTION

Fracturing of an underground hydrocarbon formation along a wellbore extending through the formation by injection of pressurized fluids into the formation via the wellbore have been used for a number of years.

Specifically, injection of pressurized fluids in hydrocarbon formations at pressures above formation dilation pressures has been used in the past to provide fractures and fissures in rock surrounding a wellbore, to thereby stimulate a reservoir to release hydrocarbons therein by providing channels within the fractured rock whereby hydrocarbons in the formation may then flow through to then be collected.

The fracturing fluid which is provided under pressure may be a non-compressible fluid such as water, and/or further containing proppants and/or hydrocarbon diluents for the purpose of not only creating fissures in the rock but for further propping and maintaining the fissures in an open position to allow hydrocarbons to flow through and/or reduce the viscosity of oil and cause it to more readily flow through created fissures in the rock.

Disadvantageously, however, in hydrocarbon formations where the characteristics of the formation may not be completely understood or known at all locations in the formation, injection of pressurized fluids along an entire length of a wellbore may inadvertently inject liquids into regions of the formation where the porosity of the formation at certain regions may already be such that such is not needed, or are locations containing relatively less hydrocarbons, which in either case such is wasteful of the injected fluid. This is particularly of concern in instances around the world where water, which is typically a principal component of the injected fluid, is scarce, difficult to obtain, or not available.

Also disadvantageously, hydrocarbon reservoirs often possess regions of higher water content. Fracturing along an entirety of the length of a wellbore and thus in all regions of a formation bounding a wellbore will typically undesirably result in fracturing of rock in one or more higher water content regions. Such fracturing thereby allows water therein to more easily flow out of such regions and into the wellbore, and conversely allows hydrocarbons to flow into these regions when water has vacated, thereby detrimentally affecting recovery of hydrocarbons through the wellbore.

Accordingly, for the above reasons, indiscriminate fracturing along a wellbore, without having intimate knowledge of the in situ geology and in particular the porosity of the formation directly in the region of the wellbore often leads to reduced recovery from the formation via that wellbore that would otherwise be the case if the porosity and "tightness" of the hydrocarbons at various discrete locations along the wellbore was otherwise known.

Accordingly, a real need exists in the petroleum industry of an in-situ method to allow reservoir and production engineers to better understand, for a particular reservoir, the geology and porosity of the formation in regions bordering the wellbore, and in particular which regions of a formation immediately adjacent such wellbore may be "tight" and thus where hydrocarbons are potentially trapped and which are in need of stimulation through fracturing and/or injection of proppants and/or diluents, as distinguished from other regions of the formation along a wellbore which are not as "tight" and for which injection of fluids into such regions may not produce as much benefit and/or stimulation thereof which may prove detrimental to hydrocarbon recovery.

As regards downhole tools for injecting fluid under high pressures as commonly used for conducting fracturing operations, such tools have likewise been known and used for a number of years. More recently, however, downhole tools have been developed which provide high pressure cyclic pressure surges, instead of a single high pressure, which is more effective in providing stimulation as it avoids constant high pressure application to the formation which might otherwise displace oil from the region of the wellbore and/or negatively affect the created fissures.

Examples of recent downhole tools which provide pulses of pressurized fluid at pressures in excess of formation dilation pressures to propagate pressure waves through a formation are tools/valves such as those described in U.S. Pat. No. 7,806,184 entitled "Fluid Operated Well Tool" and U.S. Pat. No. 7,405,998 entitled "Method and Apparatus for Generating Fluid Pressure Pulses", each of said patents commonly assigned to one of the a co-assignees of the within invention.

SUMMARY OF THE INVENTION

As used herein, and within the claims, the term "fracturing" or "stimulation" of a well or wellbore is intended to mean, and is defined as including, not only fracturing a formation by injection of pressurized fluids, such as water, proppants, and the like, but also includes dilation or any stimulation whereby any fluids, including gases or combinations thereof, are injected for the purpose of changing the absolute or relative permeability of the formation.

As also used herein and within the claims, the term oil is intended to include, and is defined as including all hydrocarbons.

As also used herein and within the claims, the term "wellbore" shall mean any borehole within a hydrocarbon formation, either an uncased wellbore or a wellbore cased with a perforated or porous casing.

In order to avoid the aforesaid problems with prior art fracturing and stimulation techniques which apply indiscriminate fracturing of a wellbore along its length by applying fluid pressure at discrete intervals along a wellbore at a pressure above the rock fracture pressure in such regions, and to instead provide for customized (ie optimized) reservoir stimulation at intervals along a wellbore where such stimulation will be best put to use, the invention in a first broad embodiment thereof provides for a pre-stimulation information gathering method which allows for an in-situ determination of relative porosities of regions of the formation bordering the wellbore, prior to conducting formation dilation by injection of pressurized fluid in excess of formation dilation pressure.

Such pre-stimulation "information gathering" method advantageously allows determination of the porosities and geology of such regions and provides valuable quantitative information as to the relative ease of penetration of fluids in such regions of the formation by subjecting various discrete intervals along the length of a collection wellbore to a pressurized fluid at a pressure less than formation dilation pressure and/or fracturing pressure. Analysis of the ease of penetration of such fluid into the formation at each of the discrete intervals along the wellbore, and in particular determining regions of the formation which are "tight" and in particular are resistant to fluid penetration allows determination of regions along the wellbore which would benefit best from subsequent stimulation, namely injection of a pressurized fluid at a pressure greater than formation dilation pressure or rock fracture pressure in such regions, to thereby best utilize such stimulation method in the regions of the wellbore which will best benefit from stimulation, and avoid use in regions for which stimulation would not be as beneficial, or would be detrimental.

Accordingly, in a first broad aspect of the present invention the invention relates to a method for determining along a length of a wellbore situated in an underground hydrocarbon-containing formation, regions within said formation along the wellbore where injection of a fluid at a pressure above formation dilation pressure may likely be advantageous or useful for stimulating production of oil into the wellbore as compared to various other locations along said wellbore, comprising the steps of:

(i) applying, via fluid pressurization means, a fluid at each of discrete intervals along said wellbore, at a first pressure below formation dilation pressure; and (ii) sensing, via sensing means, for each of said discrete intervals, a value or values indicative of a rate of, a volume of, or extent of, fluid penetration within each a region of said formation proximate said discrete interval when said first pressure is applied, and compiling said value or values for each associated discrete location along said wellbore.

The fluid pressurization means may be a tool/valve situated at surface, wherein pressurized fluid is pumped downhole, or alternatively may be a tool/valve which may be situated downhole in the wellbore, each of which may further be adapted to apply cyclic pressure pulses. In an embodiment of the method where a single downhole tool/valve is used, such downhole tool/valve may be moved within the wellbore to successive discrete locations along the wellbore, and fluid pressure pulses provided at each of such discrete intervals (at fluid pressures below formation dilation pressure), in order to acquire the desired information regarding ease of fluid penetration at each of the discrete intervals along the wellbore.

Alternatively, in another embodiment of using downhole fluid pressurization means, a plurality of downhole tools/valves are located downhole, at a plurality of discrete intervals along a length of the wellbore. Fluid pressure is then supplied simultaneously to each of such downhole tools/valves, in order to simultaneously acquire the desired information regarding ease of fluid penetration at each of the discrete intervals along the wellbore. This refinement of the method has the advantage of allowing for rapidly determining the regions within the formation for subsequent optimal stimulation. The tubing associated with downhole tools and packer elements are then removed from the wellbore, and fluid pressurization means then inserted downhole to fracture the formation at only those locations where stimulation was determined to be potentially beneficial from the previous information-gathering step. Alternatively, if such downhole tools/valves are not removed from the wellbore and left therein, such requires those tools that are located in regions determined not to be beneficial for subsequent stimulation, to be controlled in a manner, such as by further having pressure-actuated sleeves or ball-actuated valves as disclosed in any one of U.S. Pat. Nos. 4,099,563, 4,993,678, 5,048,611, 7,543,634, or 7,832,472 located in such tubing to be used at each of the various discrete intervals. Such additional sleeves or valves then serve to prevent each downhole tool/valve from supplying high pressure fluid to the formation during the subsequent stimulation operation to regions where it has been determined that stimulation would not be beneficial.

Accordingly, in a further broad aspect of the method, the invention relates to a method for determining, along a length of a wellbore situated in an underground hydrocarbon-containing formation, regions within said formation along said wellbore where injection of a fluid at a pressure above formation dilation pressure may likely be advantageous or useful for stimulating production of oil into the wellbore as compared to various other locations along said wellbore, comprising the steps of:

(i) placing within said wellbore, at a plurality of discrete intervals along a length thereof, fluid pressurization means for supply of a pressurized fluid to the formation at each of said discrete intervals along said wellbore;

(ii) applying, via said fluid pressurization means, said fluid at each of said discrete intervals, at a first pressure below formation dilation pressure; and (iii) sensing, via sensing means, for each of said discrete intervals, a value or values indicative of a rate of, a volume of, or extent of, fluid penetration within each a region of said formation proximate said discrete interval when said first pressure is applied, and compiling said value or values for each associated discrete location along said wellbore.

In a preferred embodiment, a subsequent step (iv) is provided, wherein the discrete intervals determined in step (iii) above are then used to determine those discrete intervals along the wellbore where fracturing, formation dilation, stimulation, or injection of fluids at a pressure above formation dilation pressure, would potentially be desirable to assist in flow of oil from said formation at said regions.

In a refinement of step (iii), step (iii) comprises the step of sensing, via sensing means, for each discrete interval, a value indicative of a rate of pressure decay of said fluid within a region of said formation proximate said discrete interval and thereby compiling a plurality of values at associated discrete locations along said wellbore; and using the discrete intervals determined in step (iii) above which have associated values indicating low rates of pressure decay to determine those discrete intervals along the wellbore where fracturing, formation dilation, stimulation, or injection of fluids at a pressure above formation dilation pressure would potentially be desirable to assist in flow of oil from said formation at said regions.

In an alternative, the sensing means may provide, for each discrete interval, a value indicative of ease of penetration of said fluid supplied at said first pressure within a region of said formation proximate said discrete interval; and the discrete intervals determined in step (iii) above which have associated values indicating the lowest ease of penetration of fluid into said formation being used to determine those discrete intervals along the wellbore where injection of fluids a pressure above formation dilution pressure would potentially be desirable to assist in flow of oil from said formation at said regions. The ease of penetration of fluid into said formation may be determined by:

(a) a measured pressure after a given volume of fluid has been supplied at a discrete interval in a given time interval; or (b) a measured volume of fluid supplied at each of said discrete intervals at a given pressure in a given time interval;

Thereafter, the discrete intervals determined in such manner may be then used to determine those discrete intervals along the wellbore where measured pressure is highest, or measured volume of fluid supplied is lowest, to thereby determine regions where injection of fluids would potentially be desirable to assist in flow of oil from said formation at said regions.

For all of the above methods, the foregoing method may further be immediately thereafter followed by the step of supplying said fluid at a pressure above a formation dilation or fracturing pressure at said one or more discrete intervals along said wellbore as determined in step (iv) above.

In another aspect of the invention, the invention comprises a method of determining, at discrete locations along a length of a porous wellbore situated in a hydrocarbon-containing formation, regions within said formation along said wellbore where fracturing or dilation via injection of a fluid may be undesirable or not necessary, comprising the steps of:

(i) placing within said wellbore, at a plurality of discrete intervals along a length thereof, fluid pressurization means;

(ii) applying, via said fluid pressurization means, a fluid at each of said discrete intervals, at a pressure below formation dilation pressure;

(iii) sensing, via sensing means, for each discrete interval, a value or values indicative of certain reservoir characteristics within a region of said formation proximate said discrete interval and thereby compiling a plurality of values and associated discrete locations along said wellbore; and (iv) using the values associated with the discrete intervals as determined in step (iii) to determine regions along said wellbore having qualifying reservoir characteristics to determine those regions of the wellbore where fracturing, dilation, stimulation, or injection of fluids would potentially be undesirable or not useful to assist in flow of oil from said formation at said regions into said wellbore.

In a refinement of the above method, step (iii) and (iv) above respectively further comprise the steps of:

(iii) sensing, via sensing means, for each discrete interval, a value indicative of:

(a) a measured pressure after a given volume of fluid has been supplied at a discrete interval in a given time interval;

(b) a measured volume of fluid supplied at each of said discrete intervals at a given pressure in a given time interval; or (c) a rate of pressure decay of said fluid from a given starting pressure within a region of said formation proximate said discrete interval;

and compiling a plurality of said values at associated discrete intervals along said wellbore; and (iv) using the discrete intervals determined in step (iii) above which have associated values to determine those discrete intervals along the wellbore where fracturing, dilation, stimulation, or injection of fluids would not be potentially desirable or useful to assist in flow of oil from said formation at said regions.

Alternatively, above steps (iii) and (iv) may comprise the steps of:

(iii) sensing, via sensing means, for each discrete interval, a value indicative of ease of penetration of said fluid within a region of said formation proximate said discrete interval and thereby compiling a plurality of values and associated discrete locations along said wellbore; and (iv) using the discrete intervals determined in step (iii) above which have associated values indicating the greatest ease of penetration of fluid into said formation, to determine those discrete intervals along the wellbore where via injection of a fluid at a pressure above formation dilation pressure would be less likely to be necessary or useful to assist in flow of oil from said formation at said regions.

Again, all of the above pre-dilation "information gathering" methods may further be followed with the step, after step (iv), of using the fluid pressurization means to supply fluid at a pressure above a formation dilation pressure, to the wellbore at one or more discrete intervals along said wellbore other than those determined in step (iv), in a series of cyclic pressure pulses.

Another aspect of the present invention related to the above information-gathering method for determining regions of the formation most likely to benefit from subsequent stimulation relies on the fact that regions of the formation determined to have easy fluid penetration are likely to be regions in the formation containing higher amounts of water.

Accordingly, in a further embodiment of the invention such relates to a method of reducing, within a hydrocarbon-containing formation, the potential for ingress of water from said formation into a porous wellbore situated in said formation, such method comprising the steps of:

(i) placing within said wellbore, at a plurality of discrete intervals along a length thereof, fluid pressurization means which allow for supply of a pressurized fluid to said formation at a localized region proximate each of said discrete intervals;

(ii) applying, via said fluid pressurization means, said fluid at each of said discrete intervals, at a pressure below formation dilation pressure;

(iii) sensing, via sensing means, for each discrete interval, a value or values indicative of one or more reservoir characteristics within a region of said formation proximate said discrete intervals and thereby compiling a plurality of values and associated discrete intervals along said wellbore; and (iv) using the values associated with the discrete intervals determined in step (iii) to determine those discrete intervals which have qualifying associated reservoir characteristics which indicate ingress of water into the wellbore at said determined discrete intervals is a possibility; and (v) inserting restriction or barrier means via said wellbore at those discrete intervals along the wellbore determined in step (iv), so as to reduce the possibility of water entering said wellbore at said discrete intervals.

Again, the value or values sensed by the sensing means may comprise:

(a) a rate of pressure decrease of fluid supplied at said discrete intervals, over a given time interval; or (b) ease of fluid penetration within the formation at each discrete interval, wherein such ease of penetration is determined by:

(i) a measured pressure after a given volume of fluid has been supplied at a q discrete interval in a given time interval; or (ii) a measured volume of fluid supplied at each of said discrete intervals at a given pressure in a given time interval;

In a further broad aspect, the method of the present invention comprises a method of fracturing or stimulating via injection of a fluid, a hydrocarbon-containing formation at discrete locations along a length of a wellbore situated in said formation, at regions within said formation where hydrocarbons are likely present and avoiding applying such methods to said formation in regions along said wellbore where such may be unnecessary or undesirable, comprising the steps of:

(i) placing within said wellbore, at a plurality of discrete intervals along a length thereof, fluid pressurization means which allow for supply of a pressurized fluid at each of said discrete intervals;

(ii) applying, via said fluid pressurization means, said fluid at each of said discrete intervals, at a pressure below formation dilation pressure;

(iii) sensing, via sensing means, for each discrete interval, a value or values indicative reservoir characteristics at a region of said formation proximate said discrete interval and thereby compiling a plurality of values and associated discrete locations along said wellbore;

(iv) determining, using said reservoir characteristics at said discrete intervals, where formation dilation by injection of a fluid at a pressure above formation dilation would be potentially beneficial to assist in collection of oil in said wellbore; and (v) applying cyclic fluid pressure pulses via said fluid pressurization means, at pressures above said formation dilation pressure, at one or more of said discrete intervals along said wellbore determined in step (iv) above.

The fluid pressurization means for applying cyclic fluid pressure pulses may be located uphole, and may comprise an "at surface" tool for pulsed injection of liquids, and described and shown in Canadian Patent Application 2,701,261, commonly assigned to one of the co-assignees of the present invention.

Alternatively, the fluid pressurization means for applying cyclic fluid pressure pulses may comprise a downhole tool, mounted on and at the end of a tubing string from which it is supplied with pressurized fluid, such as the downhole wellbore tools/valves described in U.S. Pat. No. 7,806,184 entitled "Fluid Operated Well Tool" and U.S. Pat. No. 7,405,998 entitled "Method and Apparatus for Generating Fluid Pressure Pulses", each of said patents commonly assigned to one of the a co-assignees of the within invention.

Still further, the fluid pressurization means for applying cyclic fluid pressure pulses may comprise a newly-designed downhole tool, adapted to be mounted on, at a distal end of a tubing string located downhole with which it is supplied with pressurized fluid. In such aspect of the invention, such new tool for supplying cyclic pressure pulses of fluid downhole comprises:

a cylindrical elongate member, having an uphole end and a mutually-opposite downhole end, adapted for insertion in a wellbore; having:

(i) a reservoir chamber, situated at said downstream end, said chamber bounded at an uphole end thereof by a slidable piston member;

(ii) tubular passageway means, extending substantially a length of said elongate member, in fluid communication with said reservoir chamber and providing fluid communication between a fluid inlet at said upstream end and said reservoir chamber;

(iii) a fluid exit passage;

(iv) a valve member contacted by said tubular passageway means, having an open position and a closed position, for allowing and preventing fluid flow from said inlet area to said fluid exit passage; and (v) biasing means biasing said slidable piston member against fluid in said reservoir chamber and further biasing said tubular passageway means against said valve member so as to bias said valve member to said open position which allows fluid to exit said tool via said fluid exit passage.

In operation, upon fluid being supplied to said fluid inlet of such tool at said upstream end, and the valve member being in a closed position, fluid pressure in said reservoir chamber increases due to fluid supplied to said reservoir chamber from the fluid inlet via said tubular passageway means. The slidable piston member is caused to move upstream against said biasing means, and the biasing means then forces said tubular passageway means to move said valve member to the open position and allowing fluid from said inlet area to exit the tool via said exit passage. Fluid exiting the tool via the exit passage thereby causes an instantaneous drop in fluid pressure in both said tubular passageway means and the reservoir chamber, thereby causing said sliding piston to move downstream in said reservoir chamber and allowing said valve member to move to a closed position. The cycle then repeats for the tool, and is self-sustaining until fluid pressure supplied from surface is relaxed or halted.

BRIEF DESCRIPTION OF THE DRAWINGS

The accompanying drawings illustrate one or more exemplary embodiments of the present invention and are not to be construed as limiting the invention to these depicted embodiments. The drawings are not necessarily to scale, and are simply to illustrate the concepts incorporated in the present invention.

DETAILED DESCRIPTION OF PREFERRED EMBODIMENTS

Figure 1:
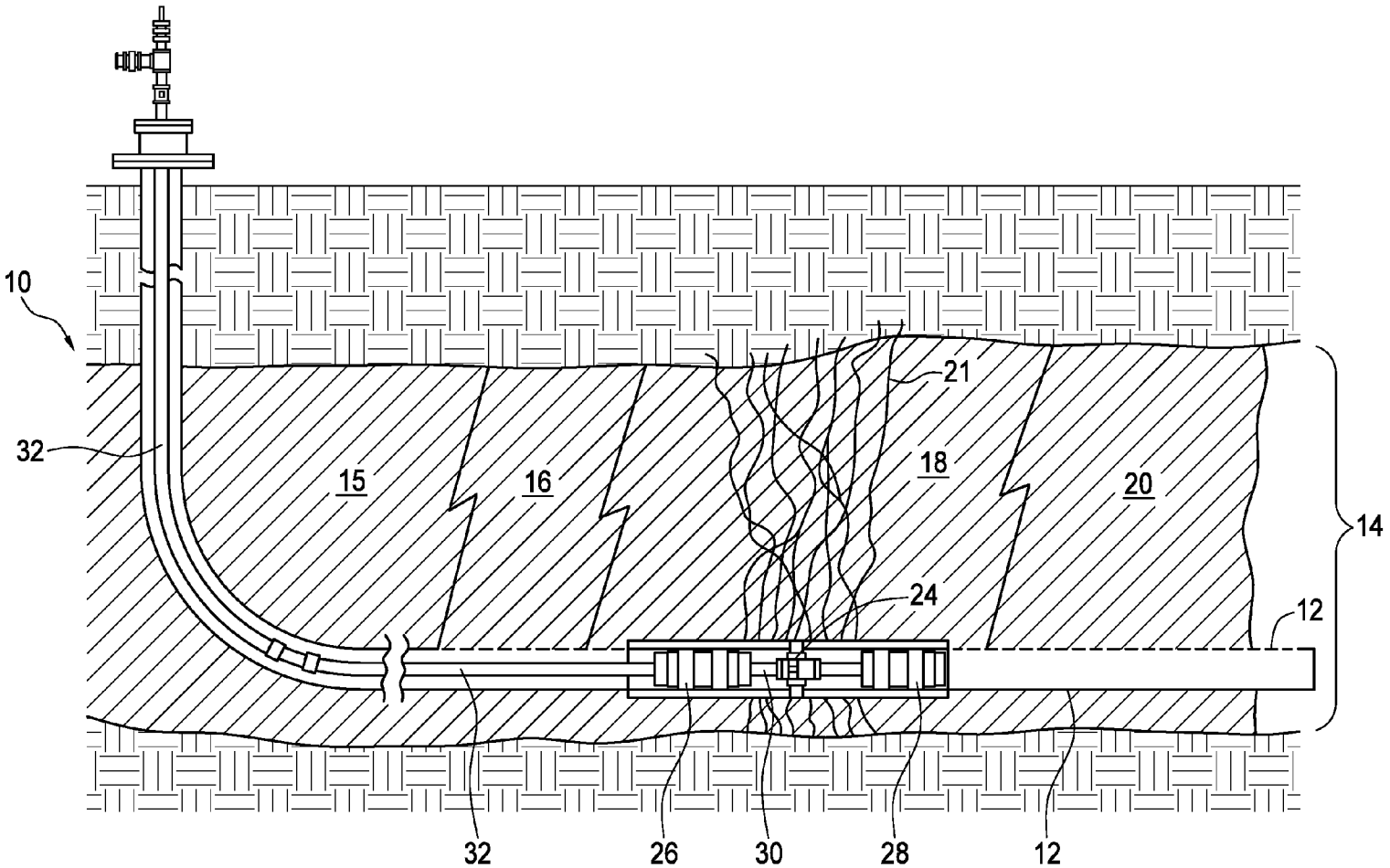
FIG. 1 (Prior Art)
FIG. 1 shows a cross-sectional view of a wellbore using a method of the prior art for stimulating regions within a hydrocarbon-containing formation. A pressurized fluid supply tool, interposed between two packer elements and located at the distal end of tubing inserted downhole in a wellbore, is supplied with fluid under a pressure exceeding wellbore dilation pressure, which causes fracture of rock in the formation surrounding the wellbore.

With reference to the drawings FIGS. 1-12, like or similar elements are designated by the same reference numeral through several views and figures. However, such elements are not necessarily shown to scale in drawings FIGS. 1-12.

FIG. 1 shows a cross-sectional view of a hydrocarbon-containing formation 10 having a horizontal wellbore 12 drilled within a "pay" zone 14 thereof, which depicts a prior art method of fracturing regions 15, 16, 18, and 20 of hydrocarbon-containing formation 10, with region 18 shown being fractured by fluid pressurization via tool 24, thereby creating of fissures 21 within rock surrounding wellbore 12. In such prior art method, a fluid pressurization means, such as a downhole tool/valve 24, interposed between two double-packer elements 26, 28 and located at the distal end 30 of a tubing 32, which may be continuous tubing, coiled tubing, or discrete pipe lengths threadably coupled together, is inserted downhole in wellbore 12 for providing cyclic pressure pulses, at a pressure above formation dilation pressures, at various discrete intervals along wellbore 12, to cause formation dilation and/or fracturing of rock in the formation 10. Specifically, in such prior art method depicted in FIG. 1, downhole tool/valve 24 is supplied with fluid under a pressure exceeding wellbore dilation pressure, which causes fracture of and fissures 21 in rock within formation 10, and in particular within region 18 surrounding the wellbore 12. Downhole tool/valve 24 is subsequently repositioned to other remaining discrete intervals along wellbore 12, so as to successively fracture regions 15, 16 and 20 along wellbore 12, so that the formation 10 is fractured along the entirety of the length of wellbore 12 and thus at each of regions 15, 16, 18, and 20 therealong. a cross-sectional view of a hydrocarbon-containing formation 10 having a horizontal wellbore 12 drilled within a "pay" zone 14 thereof, which depicts a prior art method fracturing exemplary regions 16, 18, and 20 of hydrocarbon-containing formation 10, with region 18 shown being fractured by the creation of fissures 21 within rock surrounding wellbore 12.

Notably, hydrocarbon-containing formations 10 typically are non-homogenous, possessing distinct regions such as regions 16, 18, and 20 through which wellbore 12 passes and which thus border wellbore 12. Each of separate distinct regions such as regions 16, 18, and 20 which are shown for illustrative exemplary purposes, typically possess distinct and separate geological properties (ref. FIG. 1), such as of different densities and porosity, rock type (and whether such rock is of a consolidated or unconsolidated nature), and each of varying levels of oil and water saturation.

Thus disadvantageously, as explained in the "Background of the Invention" herein, where the characteristics of the formation 10, and in particular the geology, individual properties of, and number of, distinct regions with formation 10, and in particular in such regions as regions 16, 18, and 20 which border wellbore 12 may not be completely understood or known as to all properties, and thus injection of pressurized fluids along an entire length of a wellbore 12 may inadvertently inject liquids into regions of formation 10 such as, for example, region 18 of the formation 10, where the porosity of the formation at such region 18 may already be such that stimulation is not needed. Thus indiscriminate stimulation in regions immediately surrounding wellbore 12, such as region 18 which may be sufficiently porous and/or or of a geology to not require dilatation, results in wastage of fluid and delay in completing stimulation along wellbore 12. Wasteful use of injected fluid is of particular concern in locations around the world where sources of surface water to be pumped downhole (water being typically a principal component of the injected fluid) is scarce and difficult to obtain.

Also disadvantageously, hydrocarbon reservoirs often possess regions of higher water content and higher water saturation. Stimulation along an entirety of the length of a wellbore 12 and thus in all regions 16, 18, and 20 of a formation 10 bounding a wellbore 12 will typically undesirably result in stimulation of rock in one or more higher water content regions. Such stimulation thereby allows water therein to more easily flow out of such regions such as region 18 and into the wellbore 12, and conversely allows oil to flow into these regions 18 when water has vacated, thereby detrimentally affecting recovery of hydrocarbons through the wellbore 12.

Accordingly, for the above reasons, indiscriminate stimulation methods of the prior art which fracture formation 10 along an entire length of a wellbore 12, or even in selected lengths without having intimate knowledge of the in situ geology and in particular the porosity of the formation 10 in each of regions along and proximate wellbore 12 often leads to reduced recovery from the formation 10 than would otherwise be the case if the porosity and "tightness" of the hydrocarbons in the reservoir 10 near each and all of the discrete intervals along the wellbore 12 was otherwise known, or known with greater precision.

Figure 7:
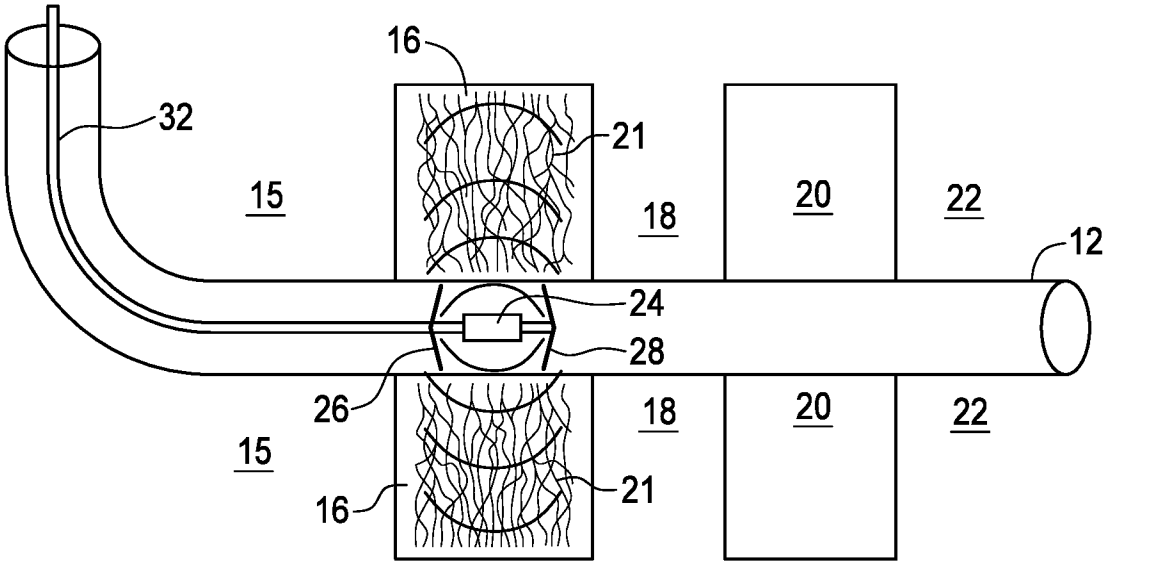
FIG. 7 is a similar cross-sectional view of the wellbore, after completion of the above "information gathering" steps, wherein the fluid pressurization tool is positioned at a first location in the wellbore where is was determined by the foregoing "information gathering" steps that stimulation would be beneficial, wherein such pressurization tool is provided with fluid under pressure at the pre-determined desired interval, and stimulation of the surrounding rock is being carried out.
Figure 8:
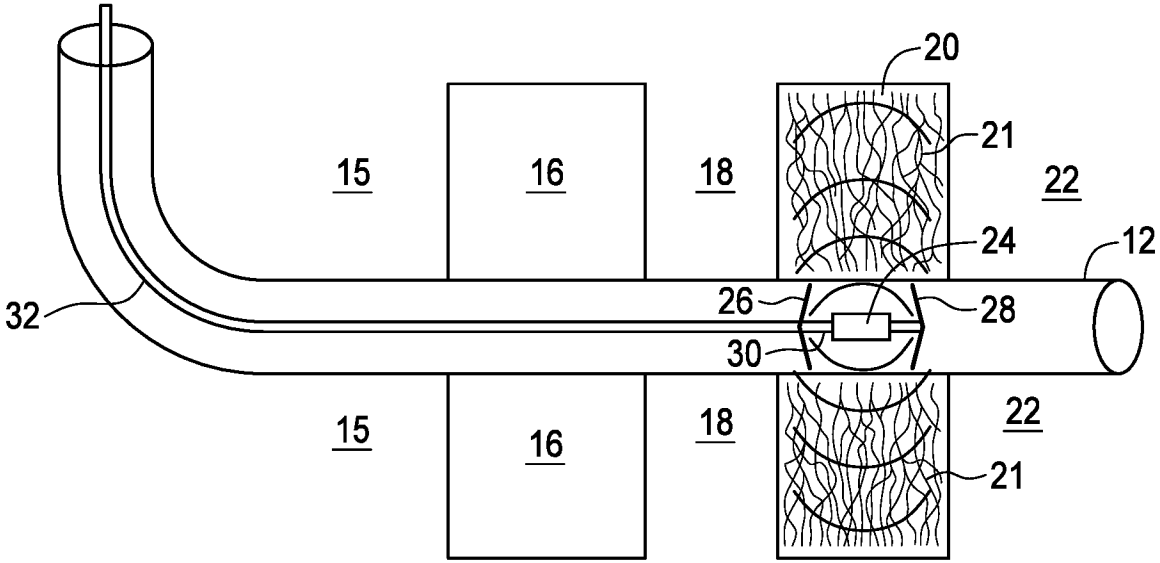
FIG. 8 is a similar cross-sectional view of the wellbore, after completion of the above "information gathering" steps, wherein the fluid pressurization tool is positioned at a second location in the wellbore where is was determined by the foregoing "information gathering" steps that stimulation would be beneficial, wherein such pressurization tool is provided with fluid under pressure at one of the pre-determined interval, and stimulation of the surrounding rock is being carried out at such interval.

The method of the present invention, as shown schematically in FIGS. 2-6, and FIG. 12, provides an initial information-gathering step to be carried out at pressures below formation dilation pressures, prior to conducting actual fracturing or formation dilation at pressures above formation dilation pressures, as shown in FIGS. 7,8. Such information-gathering method allows initial acquisition of information as to reservoir/formation characteristics, in particular information as to ease of fluid penetration at discrete intervals along the entirety of the length of wellbore 12 (ie information with regard to the formation in regions directly bordering the wellbore 12), namely those regions such as for example regions 15, 16, 18, 20, and 22 bordering wellbore 12 and extending outwardly therefrom, to allow identification of optimum locations for a subsequent stimulation operation.

One of the methods of the present invention is depicted in the successive series of steps shown in successive figures FIGS. 2-6 herein.

Figure 2:
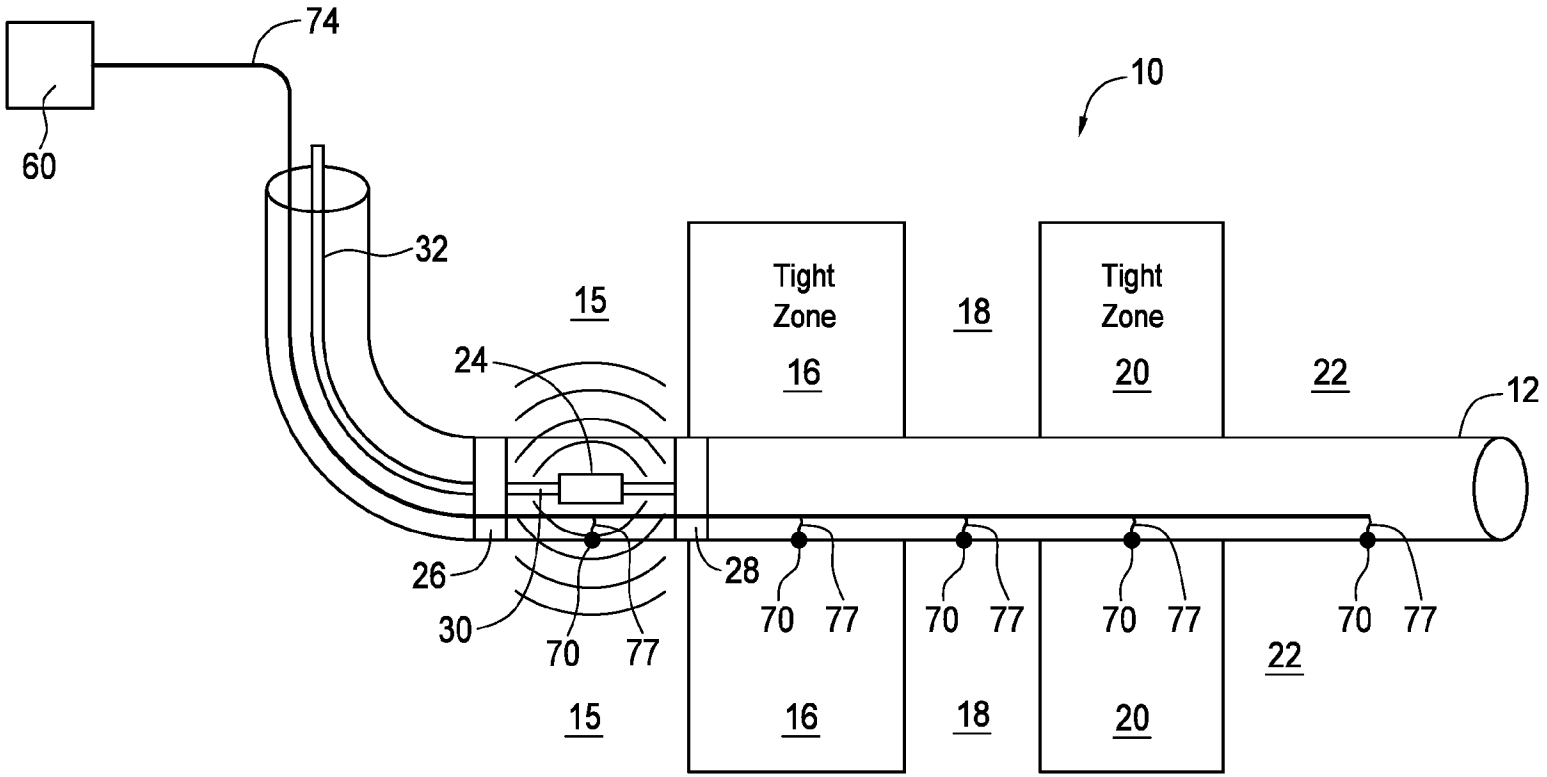
FIG. 2 is a cross-sectional view of a wellbore using the "information-gathering" method of the present invention, for obtaining reservoir characteristics of the formation at a series of discrete locations along the wellbore, showing a pressurized fluid supply tool interposed between two packer elements and located at the distal end of a tubing, wherein sensor means are located at discrete intervals along the wellbore, and the pressurized fluid supply tool is located at a first of said discrete intervals along the wellbore.
Figure 3:
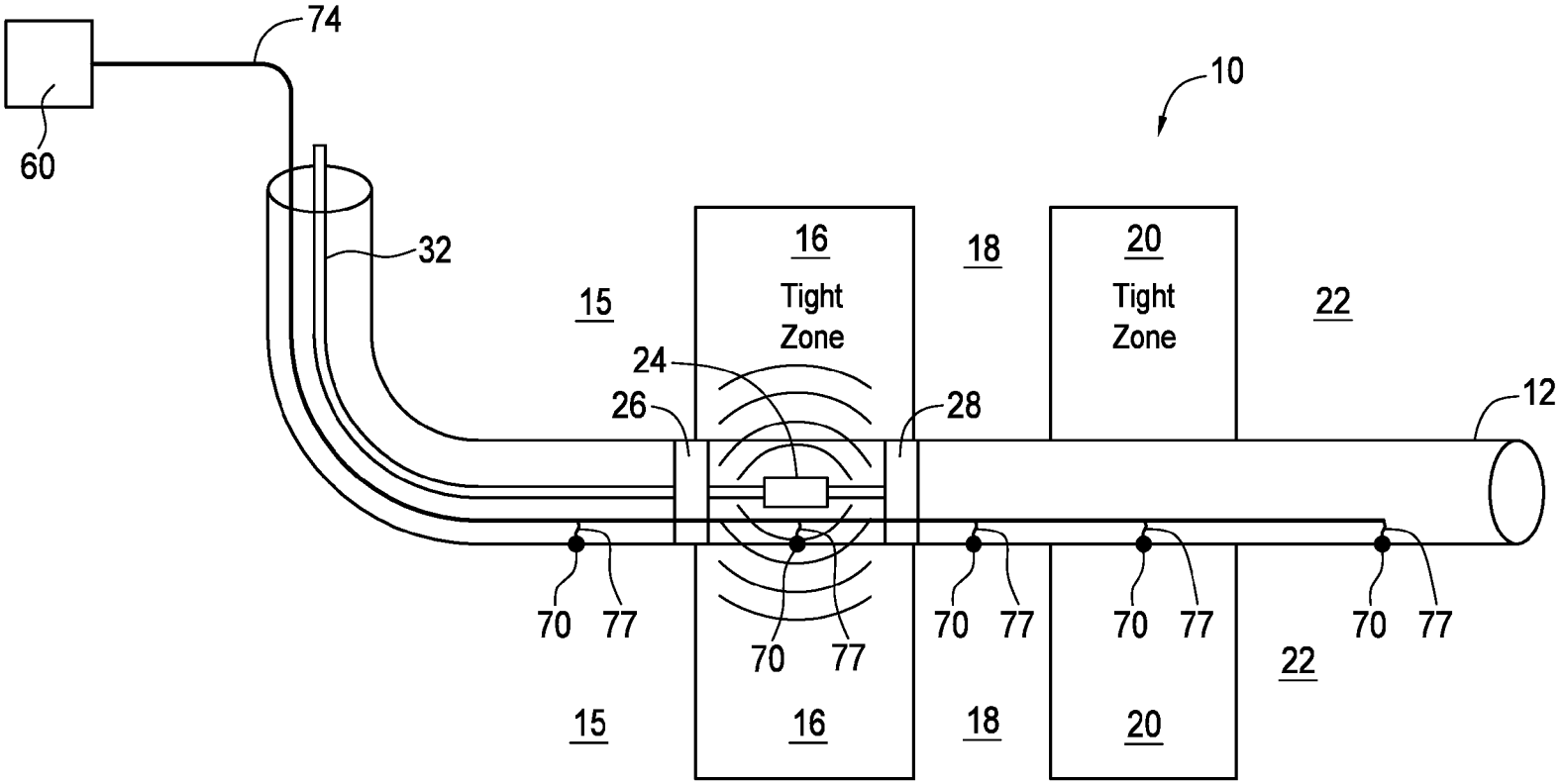
FIG. 3 is a similar cross-sectional view of a wellbore using the "information-gathering" method of the present invention, at a further successive step in the method, where the fluid pressurization means has been subsequently repositioned to a second of such discrete intervals along the wellbore, and fluid at a pressure less than formation dilation pressure is supplied.
Figure 4:
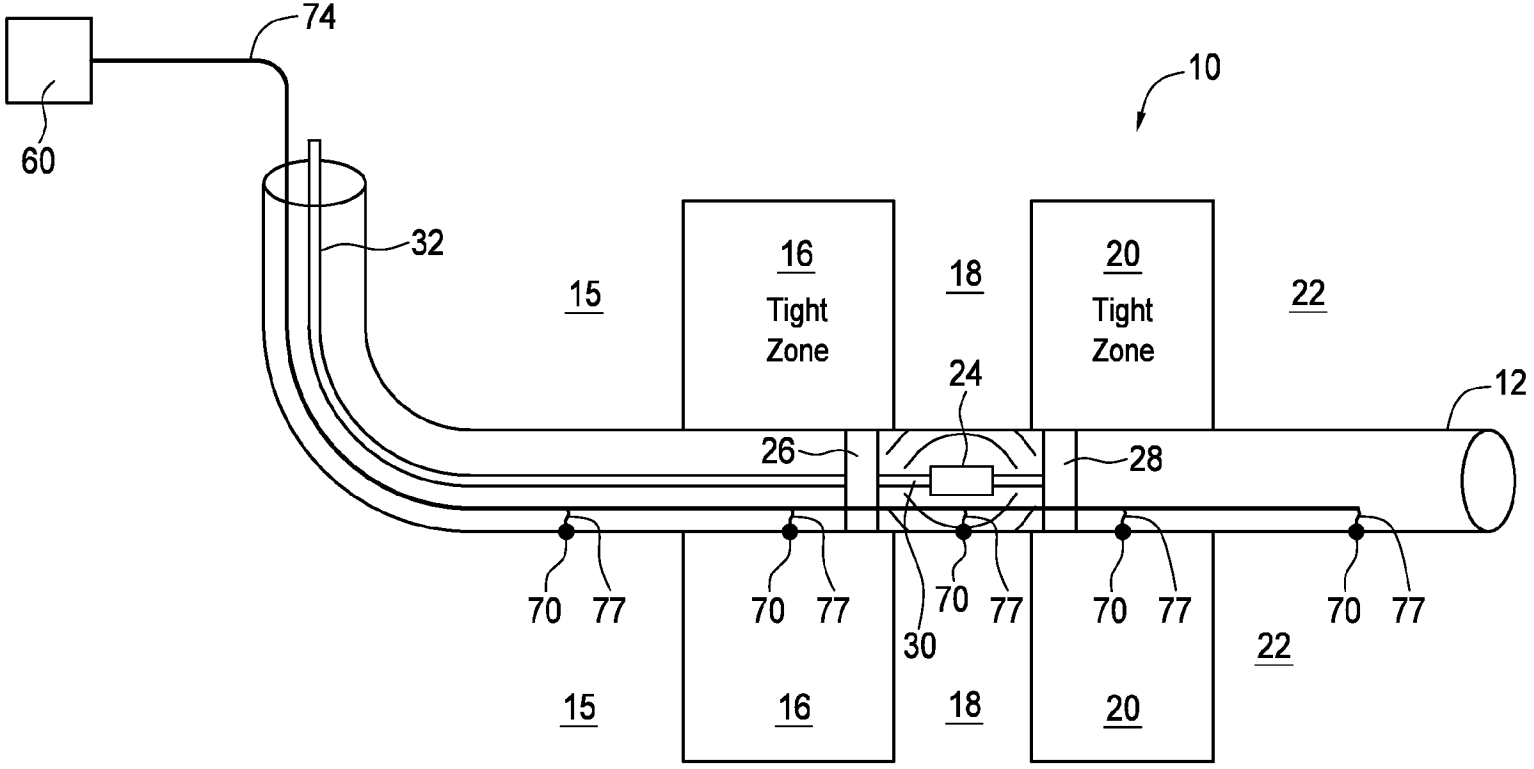
FIG. 4 is a similar cross-sectional view of a wellbore using the "information-gathering" method of the present invention, at a further successive step in the method, where the fluid pressurization means has been subsequently repositioned to a third of such discrete intervals along the wellbore, and fluid at a pressure less than formation dilation pressure is supplied.
Figure 5:
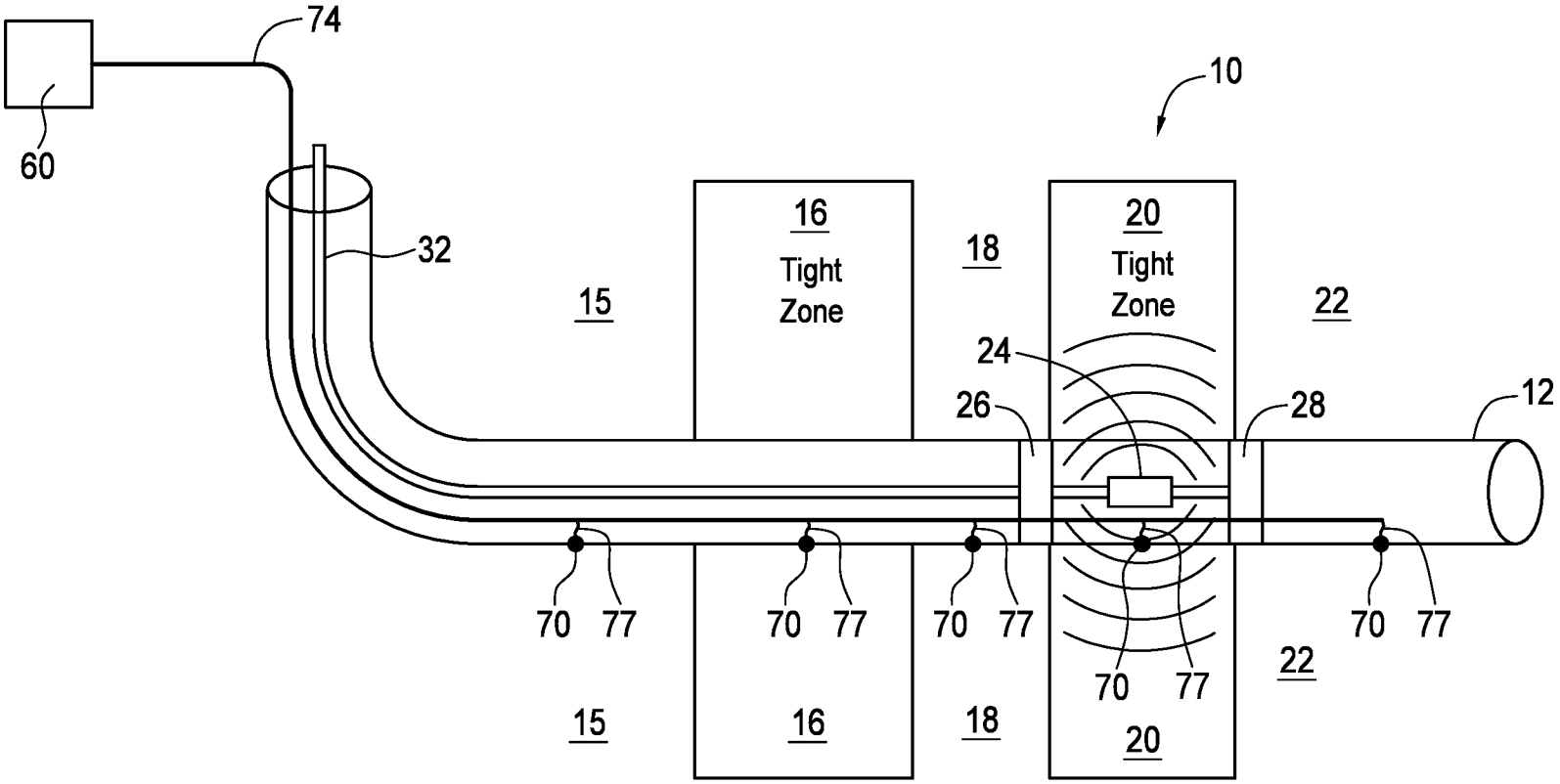
FIG. 5 is a similar cross-sectional view of a wellbore using the "information-gathering" method of the present invention, at a further successive step in the method where the fluid pressurization means has been subsequently repositioned to a fourth of such discrete intervals along the wellbore, and fluid at a pressure less than formation dilation pressure is supplied.
Figure 6:
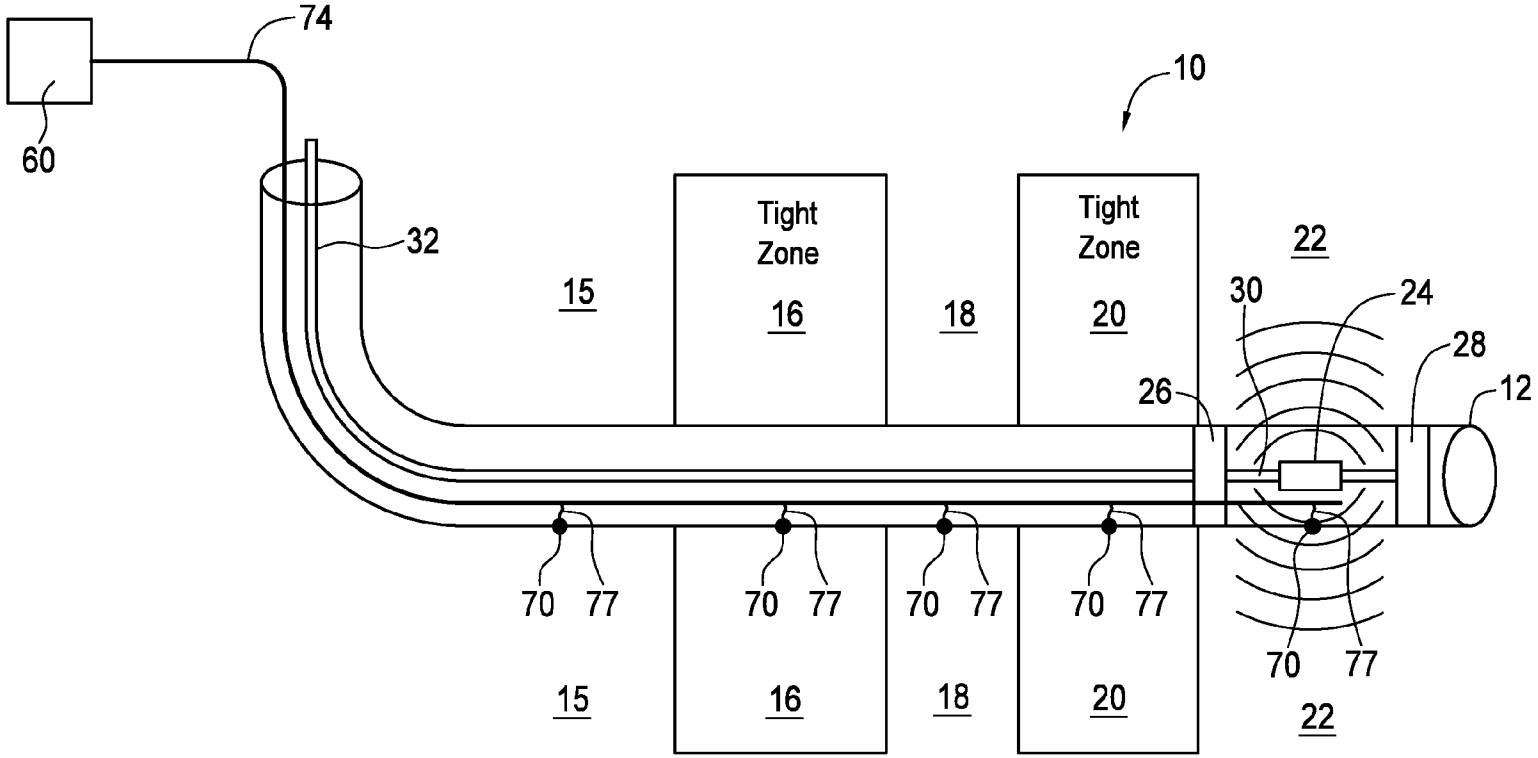
FIG. 6 is a similar cross-sectional view of a wellbore using the "information-gathering" method of the present invention, at a further successive step in the method, where the fluid pressurization means has been subsequently re-positioned to a fifth of such discrete intervals along the wellbore, and fluid at a pressure less than formation dilation pressure is supplied.

In this regard, FIG. 2 depicts an initial step in such method. Fluid pressurization means in the form of a downhole tool/valve 24 is first interposed between two packer elements 26, 28 and located at the distal end 30 of tubing 32. Downhole tool 24 and associated packers 26, 28 are thereafter inserted via such tubing 32 downhole in wellbore 12, at an initial discrete interval along wellbore 12, as shown in FIG. 2. When the downhole tool/valve 24 is positioned at such initial discrete interval, a fluid such as water is supplied to such valve 24, at a pressure less than formation dilation pressure. A plurality of sensors 70 are provided at spaced discrete intervals along wellbore 12.

In one embodiment communication line 74 comprises a plurality of electrical lines, with each individual sensor 70 in electrical communication therewith via corresponding electrical feeder lines 77, all in electrical communication with communication line 74 and thus with surface. Other means and manners of sensors 70 being in communication with surface will now be apparent to persons of skill in the art, such as by fibre optic cable or such other means, such as single bus line 74 with separate channels for each sensor 70.

Communication line(s) 74 is/are in communication with recordal means 60 at surface. Recordal means 60 is provided for electronically receiving and storing information, as more fully explained below, which is supplied by sensors 70, and may comprise a personal computer having a hard drive or flash memory (not shown), and may further comprise multiplexing means (not shown) if only one communication line 74 is used in order to be able to receive and record data simultaneously from sensors 70, which may be numerous depending on the spacing of the discrete intervals and the length of wellbore 12.

Only one sensor 70 need be used with the method shown in FIG. 2-6, which sensor 70 progressively moves in conjunction with downhole tool 24 from discrete interval to subsequent discrete interval. Alternatively a plurality of sensors 70 may be employed as shown in FIGS. 2-8, with a respective sensor 70 providing information/data for each particular discrete interval.

Sensor(s) 70 are adapted to provide very localized data/information as to the ease of penetration of fluid through a particular region of the formation 10 proximate a given discrete interval along the wellbore 12 at which an individual sensor 70 is located. Sensors 70, alone or in combination with recordal means 60 [recordal means 60 may not only provide a data recordal function, but may further provide subsequent data manipulation, such as to convert raw flow rates of fluid into flow rates per a given measured time interval for each of the respective discrete locations], are each adapted to sense one or more of the following parameters:

(i) rate of pressure decrease within the region of the wellbore 12 bounded by the porous wellbore 12 (which has apertures therein to allow egress of fluid under pressure into regions 15, 16, 18 & 20 of the formation 10), and each of the packer elements 26, 28, over a given interval of time. For such purposes numerous existing pressure sensing devices 70 may be suited, provided each adapted to withstand temperatures and pressures to which the devices may be subject downhole;

(ii) volume of fluid forced into a particular region (eg in FIG. 2, region 15) during a particular time interval. In such instance, volumetric measurement of supplied fluid supplied via tubing 32 is likely most easily determined from a sensor 70 positioned at surface, and need not be located downhole; and/or (iii) the extent of penetration of fluid into regions of the formation. In such case, such sensors 70 may comprise electronic probes which sense variations in electrical resistivity or conductivity of the formation 10 in the regions such as region 15 which is the particular region 15 being subjected to fluid penetration from tool/valve 24 in FIG. 2, both before and after being subject to such fluid pressure via tool/valve 24, relying on the principal that the electrical resistivity/conductivity of formation 10 is dependent on the extent of water saturation, particular where the saturating water contains brine as is frequently and often the case in underground formations and/or the injected fluid being injected via tubing 32 and downhole tool/valve 24 is an ionic electrically conductive fluid. Sensors 70 in such embodiment comprise one half member of a pair of electrical probe members, with the other corresponding probe members being located along similar spaced discrete distances on top of, or within each region 15, 16, 18, & 22, to thereby measure the electrical resistivity of a region before, and after, being subjected to fluid pressure, to thereby obtain relative comparable value as between the regions 15, 16, 18, 20 and 22 as to the extent of fluid penetration within a particular region relative to other regions.

FIGS. 3, 4, 5, & 6 further depict successive stages of the information gathering method of the present invention, showing successive movement of the downhole tool 24 and associated packer elements 26, 28 along wellbore 12 toward and up to the toe of wellbore 12, with successive application of fluid pressure via tool 24 at each of respective successive discrete intervals along wellbore 12 for supply of pressurized fluid to successive regions 16, 18, 20, and 22 of formation 10, with the gathering by sensor (s) 70 of the above information/data at each of the respective discrete intervals shown in FIGS. 3-6.

Figure 12:
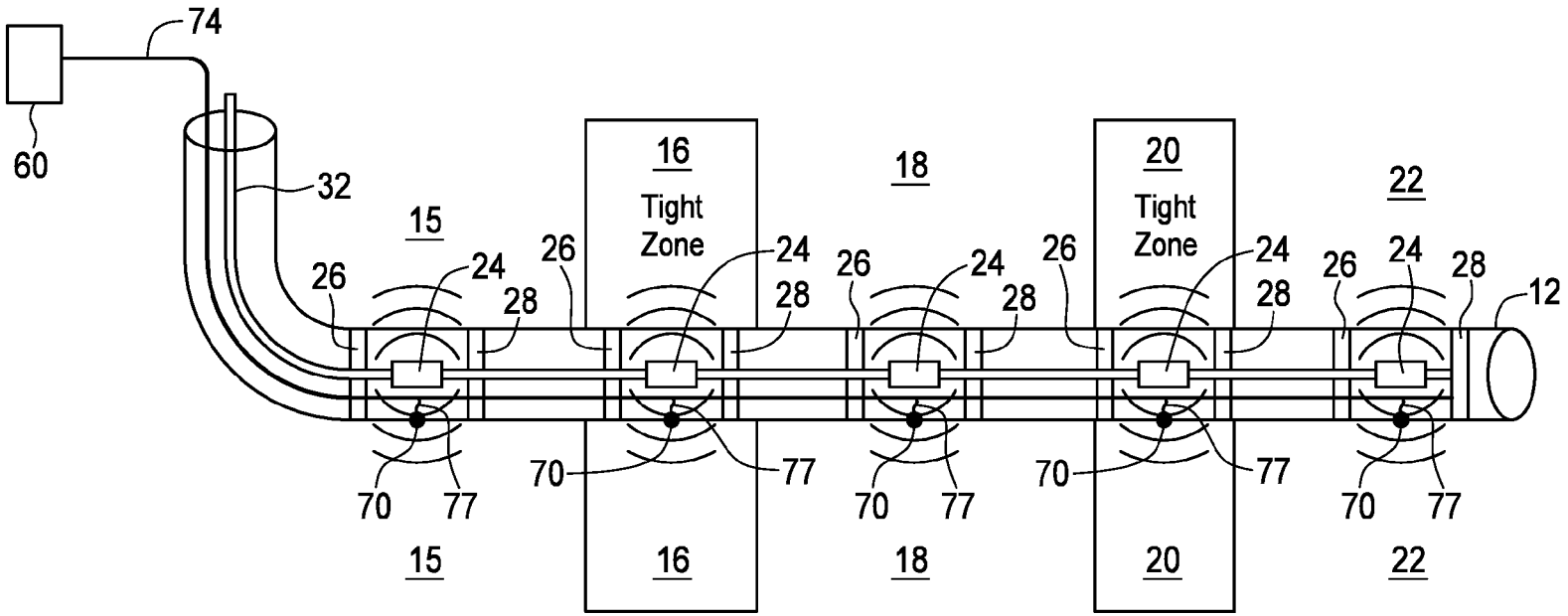
FIG. 12 depicts a cross-sectional view of a wellbore using a modified form of the "information-gathering" method of the present invention, which advantageously is able to gather information simultaneously along the entirety of the wellbore.

FIG. 12 shows an alternative embodiment of the method of the present invention.

In such method shown in FIG. 12, a plurality of downhole tools 24 are provided, each interposed between respective packers 26, 28 which together provide a respective pressure seal within wellbore 12 so as to prevent fluid from downhole tool 24 from passing upwell or downwell and thereby ensure that the fluid is directed through porous wellbore 12 and into regions 15, 16, 18, 20 and 22. Wellbore 12 may be comprised of well casing having screens or apertures (not shown) therein] to allow fluid communication with regions 15, 16, 18, 20, and 22 which allow, to a measured extent, fluid penetration into respective regions 15, 16, 18, 20, and 22 of formation 10. In this method all of downhole tools/valves 24 and associated packer elements 26, 28 are positioned at the end of tubing 32 and inserted downhole within the length of a wellbore 12.

In this method, pressurized fluid is applied simultaneously to each of the five (5) discrete intervals along wellbore 12, and sensors 70 provide data relative to the ease of penetration of the fluid within each of the respective regions 15, 16, 18, 20 and 22 along wellbore 12. Thereafter, upon analysis of the data obtained from sensors 70 via communication line 74 indicating relative ease of penetration of fluids within various regions of formation 10, as recorded by recordal means 60, those regions having poor ease of penetration (such as for example, regions 18 and 20) can be individually and successively selected for subsequent stimulation, for example supply of a pressurized fluid at pressures above formation dilation pressures, so as to cause fracturing and fissures 21 in the rock surrounding wellbore 12, as shown in successive FIGS. 7 & 8.

Figure 9:
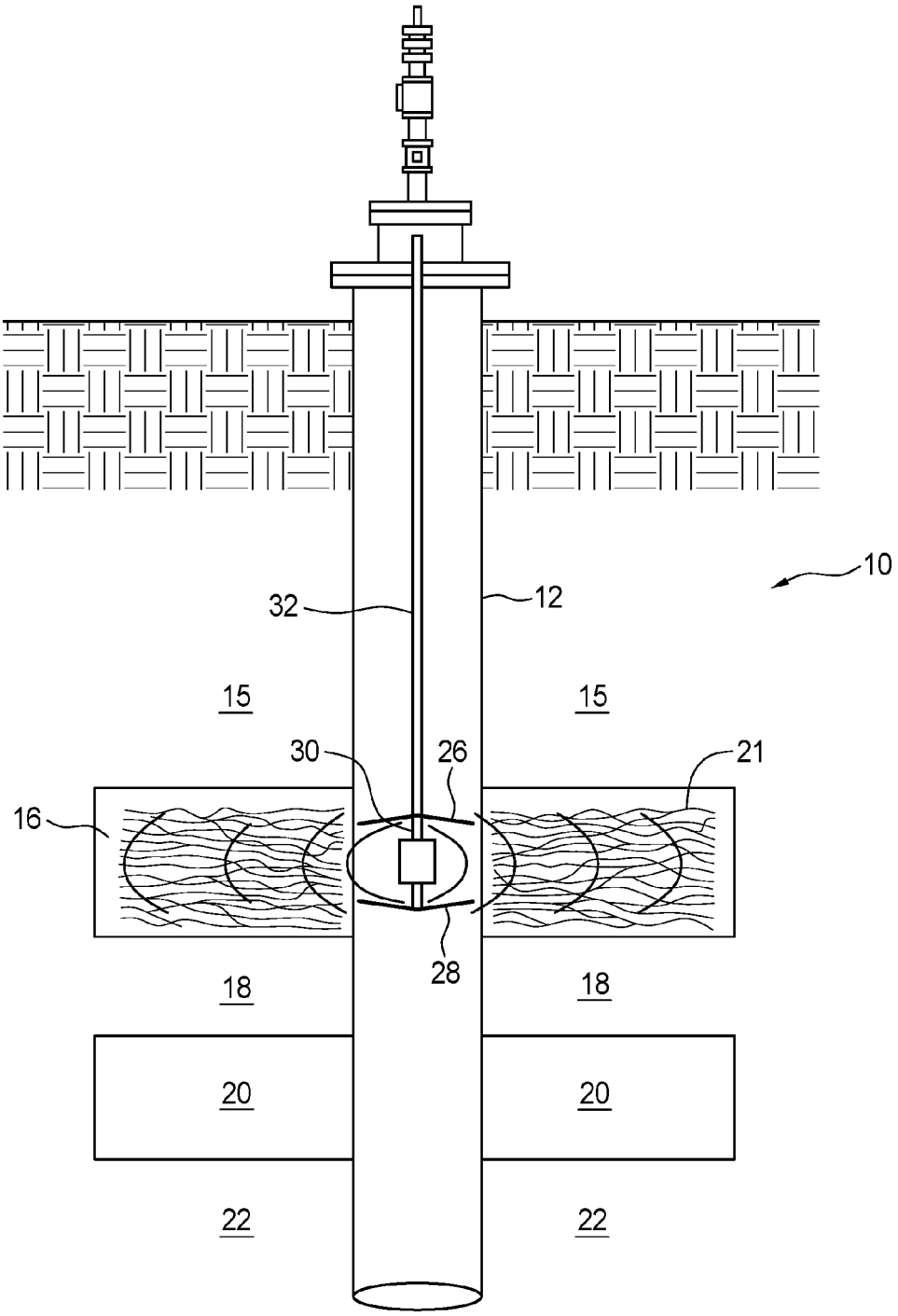
FIG. 9 is a cross-sectional view of another embodiment of the method of the present invention, wherein a vertical well is employed, and the "information-gathering" step has been carried out along discrete intervals along such vertical well and a particular distinct interval therealong as been identified as having characteristics for which stimulation may be beneficial, and a downhole tool is being used to provide stimulation of surrounding rock at such identified interval.

FIG. 9 is an example where the method of the present invention may be adapted for use in a vertical wellbore 12, instead of the horizontal wellbore 12 depicted in FIGS. 2-8. The method and apparatus used are identical to the method disclosed in FIGS. 2-8.

FIGS. 8 & 9 shows respectively application of fluid pressures, at pressures above formation dilation pressures, to respective regions 18, 20 determined by the information-gathering portion of the method of the present invention, to be regions of poor fluid penetration and to be regions which would likely benefit from subjection to fluid under a pressure in excess of formation dilation pressure.

Figure 10A:
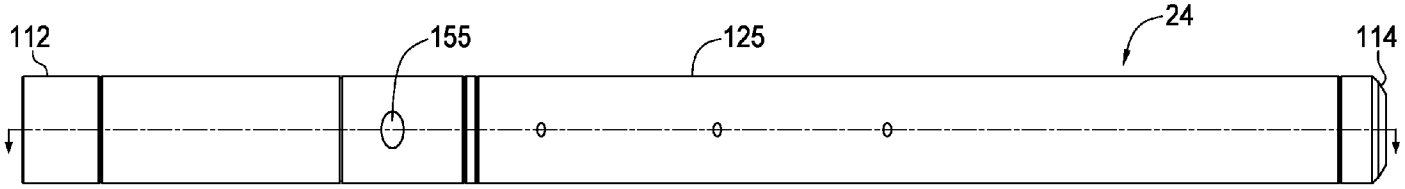
FIG. 10A is a plan view of a downhole tool/valve of the present invention for applying cyclic fluid pressure pulses, adapted to be mounted at a distal end of a tubing string (which tubing string may be continuous or coiled tubing, or discrete pipe lengths), which supplies such downhole tool/valve with pressurized fluid.
Figure 10B:
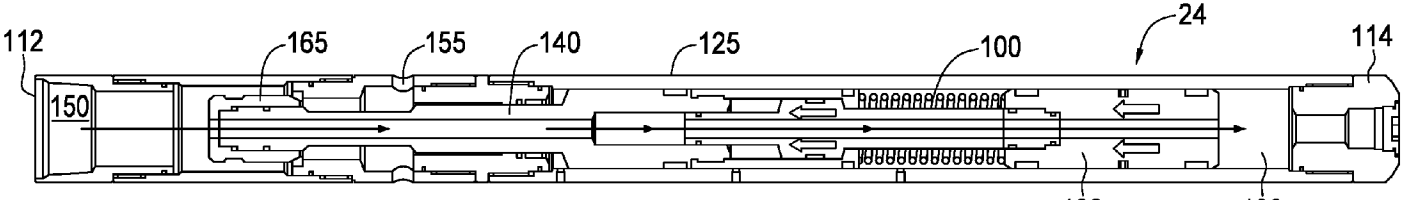
FIG. 10B is a cross-sectional view of the tool shown in FIG. 10A, taken along the longitudinal axis thereof, when the tool/valve is in the "closed" position.
Figure 10C:
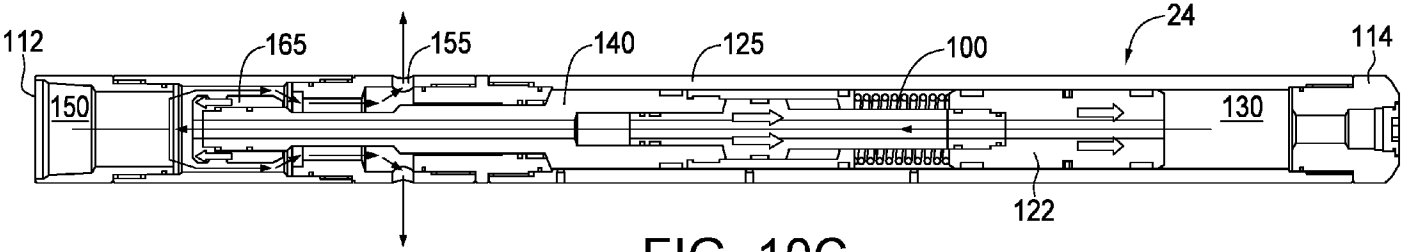
FIG. 10C is a cross-sectional view of the tool shown in FIG. 10A, taken along the longitudinal axis thereof, when the tool/valve is in the "open" position for supplying pressurized fluid to a discrete location along a wellbore.
Figure 11A:
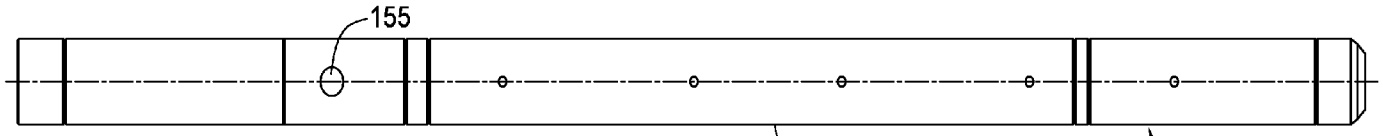
FIG. 11A is a plan view of another version of the downhole tool/valve of the present invention, similar to that shown in FIG. 10A.
Figure 11B:
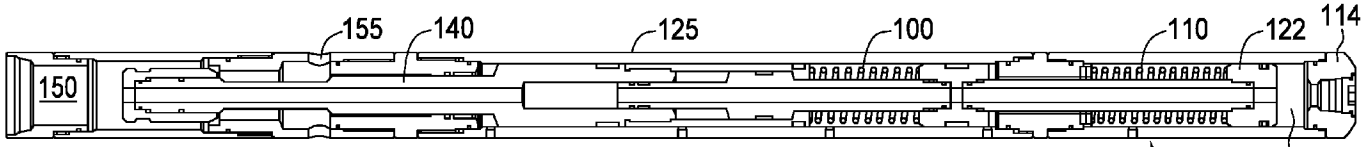
FIG. 11B is a cross-sectional view of the tool shown in FIG. 11A, taken along the longitudinal axis thereof, when the tool/valve is in the "closed" position.
Figure 11C:
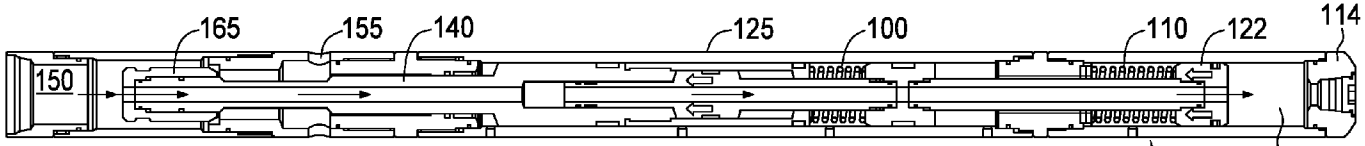
FIG. 11C is a cross-sectional view of the tool shown in FIG. 11A, taken along the longitudinal axis thereof, when the tool/valve is still in the "closed" position with the metering valve remaining seated, but with pressurized fluid being supplied to the tool/valve.
Figure 11D:
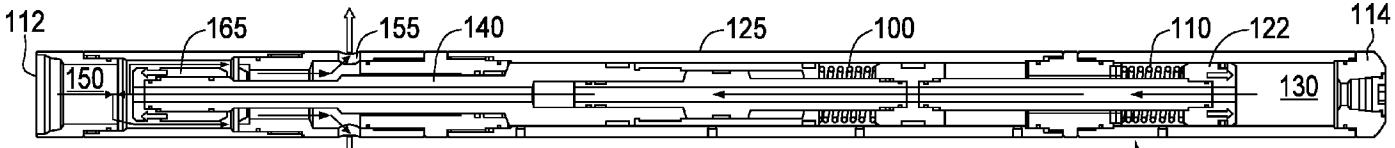
FIG. 11D is a cross-sectional view of the tool shown in FIG. 11A, taken along the longitudinal axis thereof, when the tool/valve is in the "open" position for supplying pressurized fluid to a discrete location along a wellbore.

FIG. 10A to FIG. 10C show a novel downhole tool/valve 24, useful for applying cyclic fluid pressure pulses, at either the initial information-gathering stage of the present invention, and/or the formation dilation stage of the present invention, possessing a single biasing member in the form of a spring 100.

With respect to the downhole tool/valve 24 shown in FIGS. 10A-10C, FIG. 10A is a exterior plan view thereof, comprising a cylindrical elongate member 125, having an uphole end 112 located on the left hand side of FIG. 10A, and a downhole end 114 thereof located at a mutually opposite end on the right hand side of FIG. 10A.

Each of FIG. 10B and FIG. 10C are cross-sectional views through the tool of FIG. 10A, with the tools/valve 24 shown in the "closed" position in FIG. 10B, and in the "open" position in FIG. 10C.

A reservoir chamber 130 is provided, situated at the downhole end 114, and bounded by a plug member 117 at the downhole end 114, and by a slidable piston 122. A tubular passageway 140 extends substantially a length of said elongate member 125, and is in fluid communication with reservoir chamber 130 and provides fluid communication between a fluid inlet 150 at said uphole end 112 and reservoir chamber 130.

A fluid exit passage 155 is provided in elongate member 125, which allows for controlled egress of fluid from tool/valve 24, wherein fluid flow through exit passage 155 is controlled by valve member 165. Valve member 165 is contacted by tubular passageway 140, and has an open position (FIG. 10C) and a closed position (FIG. 10B), for allowing and preventing fluid flow respectively from said fluid inlet 150 to said fluid exit passage 155.

Biasing means, in the form of helical spring member 100, is provided, and functions to bias slidable piston 122 against fluid in reservoir chamber 130 and further biases tubular passageway 140 against said valve member 165 so as to bias said valve member 165 to said open position which allows fluid to exit said tool 24 via said fluid exit passage 155.

In operation, upon fluid being supplied to fluid inlet 150 at said uphole end 112 of cylindrical member 125 and valve member 165 being in a closed position, fluid pressure in reservoir chamber 130 increases due to fluid supplied to said reservoir chamber 130 from the fluid inlet 150 via said tubular passageway 140, as shown in FIG. 10B.

Thereafter, slidable piston 122 is caused to move uphole against said spring 100, until such point as spring 100 is provided with sufficient compressive force to then suddenly force tubular passageway 140 to move valve member 165 to said open position as shown in FIG. 10C, and thereby allow fluid from said fluid inlet 150 to exit the tool 24 via said exit passage 155. Egress of fluid via passage 155 thereby causes a drop in fluid pressure in both said tubular passageway 140 and reservoir chamber 130, thereby causing said sliding piston 122 to move downhole into reservoir chamber 130, thereby reducing the force exerted by spring 100 and thus allowing valve member 165 to move back to a closed position as shown in FIG. 10B.

FIG. 11A to FIG. 11D show another novel alternative configuration for a downhole tool/valve 24', likewise useful for applying cyclic fluid pressure pulses at either the initial information-gathering stage of the present invention and/or the formation-dilation stage of the present invention The novel tool/valve 24' of FIGS. 11A-11D, in comparison to the tool/valve 24 shown in FIGS. 10A-10C, possesses an additional biasing member 110—all remaining components of tool/valve 24', and the manner of operation of valve/tool 24' and its components being substantially the same as the manner of operation and components described above in regard to the tool/valve 24 shown in FIGS. 10A-10C.

The reason for the desirability of adding a second spring 110 is that the tools/valves 24, 24' are basically a vibrational reciprocating devices, having an applied forcing function (the pressure of the fluid applied). Frequently a production engineer will wish to provide cyclic pulses at no greater than a given frequency, as pressure pulses compressed to too short a time interval (ie at too high a frequency) will negate the benefits of providing spaced-apart pressure pulses, and possibly vibrate regions of the formation to such an extent that unconsolidated rock within formation 10 is caused to fall undesirably closer together, much like shaking contents of containers which causes contents therein to settle and occupy a lesser total volume.

However, the cyclic frequency by which the tool/valve 24, 24' operates (where no vibrational control is imparted at surface to the fluid supplied) is determined by such variables as the actual pressure of the fluid supplied to the valve 24 or 24' at inlet 150, the viscosity of the fluid and thus the consequent metering (damping) of fluid flow achieved in tubular passageway 140, the stiffness and length of the springs 100 and 110, and the mass of tubular passageway 140 and sliding piston 122, as well as the damping resulting from slidable frictional movement of such components within cylindrical member 125. Some of these variables the well production engineer may have little control over, and may wish to adjust the pressure pulse frequency by adjusting the parameters of the tool 24' directly over which he/she may have control.

Accordingly, by adding one additional spring 110 to the tool 24 of FIGS. 10A-10C, thereby effectively increasing the total length (and compression of) the springs 100, 110, where the added spring 110 may further be of a greater or lesser stiffness and/or a greater or lesser length than, first spring 100 of tool 24, additional ranges of adjustment of the vibrational system can be achieved for the tool 24' to thereby permit an optimal cyclic pressure pulse to be provided by tool 24' to the formation 10. In particular such modified design 24' allows the provision of pressure pulse frequency of an acceptable high pressure, but at a frequency lower than would otherwise be achievable for a tool having only a single spring 100.

The scope of the claims should not be limited by the preferred embodiments set forth in the foregoing examples, but should be given the broadest interpretation consistent with the description as a whole, and the claims are not to be limited to the preferred or exemplified embodiments of the invention.

The invention claimed is:

1. A method of fracturing or stimulating via injection of a fluid, a hydrocarbon-containing formation at discrete locations along a length of a wellbore situated in said formation, at regions within said formation where hydrocarbons are determined to be likely present and avoiding applying such methods to said formation in other regions along said wellbore, comprising the steps of:

(i)placing within said wellbore, at a plurality of discrete intervals along a length thereof, fluid pressurization means which allow for supply of a pressurized fluid at each of said discrete intervals;

(ii) applying, via said fluid pressurization means, said pressurized fluid at each of said discrete intervals, at a pressure below formation dilation pressure;

(iii) sensing, via sensing means, for each discrete interval, a value or values indicative of reservoir characteristics at a region of said formation proximate said discrete interval and thereby compiling a plurality of values and associated discrete locations along said wellbore;

(iv) determining, using said reservoir characteristics at said discrete intervals, said discrete intervals where hydrocarbons are likely present; and (v) applying cyclic fluid pressure pulses, at pressures above said formation dilation pressure, at one or more of said discrete intervals along said wellbore determined in step (iv) above, to assist in collection of oil in said wellbore;

wherein said step of applying cyclic pressure fluid pulses via said fluid pressurization means at pressures above said formation dilation pressure comprises use of a tool, wherein said tool comprises:

a cylindrical elongate member, having an uphole end and a mutually-opposite downhole end;

a reservoir chamber, situated at said downhole end, said chamber bounded at an upstream end thereof by a slidable piston member;

a tubular passageway means, extending substantially a length of said elongate member, in fluid communication with said reservoir chamber and providing fluid communication between a fluid inlet at said uphole end and said reservoir chamber;

a fluid exit passage;

a valve member contacted by said tubular passageway means, having an open position and a closed position, for allowing and preventing fluid flow from said fluid inlet to said fluid exit passage;

biasing means biasing said slidable piston member against fluid in said reservoir chamber and further biasing said tubular passageway means against said valve member so as to bias said valve member to said open position which allows fluid to exit said tool via said fluid exit passage;

wherein upon fluid being supplied to said fluid inlet at said upstream end and said valve member being in a closed position, fluid pressure in said reservoir chamber increases due to fluid supplied to said reservoir chamber from the fluid inlet via said tubular passageway means, and said slidable piston member is caused to move uphole against said biasing means and said biasing means then forces said tubular passageway means to move said valve member to said open position and allow fluid from said inlet area to exit the tool via said exit passage, thereby causing a drop in fluid pressure in both said tubular passageway means and said reservoir chamber, thereby causing said sliding piston to move downhole in said reservoir chamber and allowing said valve member to move to a closed position.

2. A method for improving hydrocarbon recovery from a formation, the formation having hydrocarbon-dominant regions and water-dominant regions, through a wellbore passing through the hydrocarbon-dominant regions and the water-dominant regions, the method comprising the steps of:

(i) applying, via fluid pressurization means situated within the wellbore, a pressurized fluid at each of a series of discrete intervals along the wellbore, at a first pressure below formation dilation pressure;

(ii) subsequent to application of the pressurized fluid at the first pressure, sensing, via sensing means situated within the wellbore, for each of the discrete intervals, a value indicative of a rate, volume or extent of penetration of the pressurized fluid into the region adjacent the discrete interval;

(iii) assigning a threshold rate, volume or extent of penetration of the pressurized fluid, below which the value indicates the region being a hydrocarbon-dominant region;

(iv) based on the assigned threshold and the sensed value for each of the discrete intervals, determining which regions along the wellbore are hydrocarbon-dominant regions;

(v) subsequent to determining which regions along the wellbore are hydrocarbon-dominant regions, applying, via the fluid pressurization means, the pressurized fluid at each of the discrete intervals corresponding to the hydrocarbon-dominant regions, at a second pressure above the formation dilation pressure;

(vi) allowing the pressurized fluid at the second pressure to dilate the formation at only the selected hydrocarbon-dominant regions; and (vii) conducting recovery of hydrocarbon from the hydrocarbon-dominant regions through the wellbore.

3. The method of claim 2 wherein the rate, volume or extent of penetration is determined by:

(a) a measured pressure after a given volume of the pressurized fluid has been supplied at the discrete interval in a given time period;

(b) a measured volume of the pressurized fluid supplied at the discrete interval at a given pressure in a given time period; or (c) a rate of pressure decay of the pressurized fluid from a given starting pressure within the region adjacent the discrete interval.

4. The method of claim 2 wherein the pressurized fluid is applied at the second pressure in pressurized pulses.

5. The method of claim 2 wherein the pressurized fluid is applied at the second pressure in cyclic pressurized pulses.

6. The method of claim 2 wherein the sensing means comprise a fibre optic cable and multiplexing means to allow sensing of the values obtained at each of the discrete intervals.

7. A method for improving hydrocarbon recovery from a formation, the formation having high-permeability regions and low-permeability regions, the low-permeability regions preferentially retaining hydrocarbon, through a wellbore passing through the high-permeability regions and the low-permeability regions, the method comprising the steps of:

(i) applying, via fluid pressurization means situated within the wellbore, a pressurized fluid at each of a series of discrete intervals along the wellbore, at a first pressure below formation dilation pressure;

(ii) subsequent to application of the pressurized fluid at the first pressure, sensing, via sensing means situated within the wellbore, for each of the discrete intervals, a value indicative of a rate, volume or extent of penetration of the pressurized fluid into the region adjacent the discrete interval;

(iii) assigning a threshold rate, volume or extent of penetration of the pressurized fluid, below which the value indicates the region being a low-permeability region preferentially retaining the hydrocarbon;

(iv) based on the assigned threshold and the sensed value for each of the discrete intervals, determining which regions along the wellbore are low-permeability regions;

(v) subsequent to determining which regions along the wellbore are low-permeability regions, applying, via the fluid pressurization means, the pressurized fluid at each of the discrete intervals corresponding to the low-permeability regions, at a second pressure above the formation dilation pressure;

(vi) allowing the pressurized fluid at the second pressure to dilate the formation at only the selected low-permeability regions to create dilated target regions; and (vii) conducting recovery of the hydrocarbon from the dilated target regions through the wellbore.

8. The method of claim 7 wherein the rate, volume or extent of penetration is determined by:

(a) a measured pressure after a given volume of the pressurized fluid has been supplied at the discrete interval in a given time period;

(b) a measured volume of the pressurized fluid supplied at the discrete interval at a given pressure in a given time period; or (c) a rate of pressure decay of the pressurized fluid from a given starting pressure within the region adjacent the discrete interval.

9. The method of claim 7 wherein the pressurized fluid is applied at the second pressure in pressurized pulses.

10. The method of claim 7 wherein the pressurized fluid is applied at the second pressure in cyclic pressurized pulses.

11. The method of claim 7 wherein the sensing means comprise a fibre optic cable and multiplexing means to allow sensing of the values obtained at each of the discrete intervals.

* * * * *